US006730192B1

(12) United States Patent
Laapotti

(10) Patent No.: US 6,730,192 B1
(45) Date of Patent: May 4, 2004

(54) METHOD AND MACHINE FOR MANUFACTURING PRINTING PAPER OR PAPERBOARD

(75) Inventor: Jorma Laapotti, Palokka (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/031,658

(22) PCT Filed: May 2, 2000

(86) PCT No.: PCT/SE00/00826

§ 371 (c)(1),
(2), (4) Date: Apr. 22, 2002

(87) PCT Pub. No.: WO00/70142

PCT Pub. Date: Nov. 23, 2000

Related U.S. Application Data

(60) Provisional application No. 60/139,634, filed on Jun. 17, 1999.

(30) Foreign Application Priority Data

May 14, 1999 (SE) ..... 9901754

(51) Int. Cl.[7] ..... D21F 11/00

(52) U.S. Cl. ..... 162/205; 162/360.2; 162/305; 162/306; 162/358.3; 162/358.4; 162/358.1; 162/203

(58) Field of Search ..... 162/205, 203, 162/360.2, 305, 306, 358.3, 358.4, 358.1

(56) References Cited

U.S. PATENT DOCUMENTS

| | | | |
|---|---|---|---|
| 4,561,939 | A | 12/1985 | Justus |
| 5,639,351 | A | 6/1997 | Ilmarinen |

FOREIGN PATENT DOCUMENTS

| | | |
|---|---|---|
| EP | 0 487 483 A1 | 11/1991 |
| WO | WO 87/06634 | 11/1987 |
| WO | WO 00/70142 | 11/2000 |

*Primary Examiner*—Steven P. Griffin
*Assistant Examiner*—Mark Halpern
(74) *Attorney, Agent, or Firm*—Stiennon & Stiennon

(57) ABSTRACT

Printing paper or paperboard of 30–200 g/m$^2$ grammage is made in a machine with a wet section, press section and drying section. The web passes through a roll press with a double-felted roll-press nip, then in a shoe press with an extended single or double-felted shoe-press nip, and pressed in a deflection-compensating roll press, having a double-felted roll-press nip and open press rolls. The web travels at at least 1,200 m/min.; is subjected in the roll-press nip to a linear load from 100 to 300 kN-m and a specific pressure from 5 to 15 MPa; and is subjected in the shoe-press nip to a linear load from 500 to 1,500 kN/m and a specific high pressure from 4 to 13 MPa, to obtain a dewatered web with a dry-solids content of at least 38 percent after the roll-press nip and at least 45 percent after the shoe-press nip.

30 Claims, 4 Drawing Sheets

METHOD AND MACHINE FOR MANUFACTURING PRINTING PAPER OR PAPERBOARD

CROSS REFERENCES TO RELATED APPLICATIONS

This application is a national stage application of PCT Application No. PCTSJE00/00826, filed May 2, 2000, and claims priority on Swedish Application No. 9901754-3 filed May 14, 1999, and on U.S. Provisional App. No. 60/139,634 filed Jun. 17, 1999.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for manufacturing printing paper or paperboard with a grammage of 30–200 g/m$^2$ in a paper or paperboard machine, comprising a wet section, a press section and a drying section, in which method a web, formed in the wet section, is pressed in a roll press with a doublefelted roll-press nip and, thereafter, in a shoe press with an extended single or double-felted shoe-press nip.

The invention also relates to a paper or paperboard machine for manufacturing printing paper or paperboard at high speed, which printing paper or paperboard has a grammage of 30–200 g/m$^2$, comprising a wet section, a press section and a drying section, which press section includes a roll press, having a double-felted roll-press nip, and a shoe press, having an extended single or double-felted shoe-press nip.

U.S. Pat. No. 4,561,939 describes a paper machine with a press section, consisting of is a double-felted roll press and a double-felted shoe press. The roll press is of a conventional type having grooved rolls with rigid envelope suarfces. Such a configuration precludes high web speeds. After the press nip in the roll press, a suction shoe is arranged in the loop of the lower press felt, which suction shoe is intended to act so that the web accompanies the lower press felt. At high speeds, however, such a suction shoe cannot ensure such behaviour of the web. The suction shoe is an important element in the press section, according to this patent specification, which therefore does not disclose or suggest other suction devices to ensure the correct web behaviour at high speeds. Said specification employs a suction shoe after the second double-felted press nip as well, which therefore contributes to a further limitation of this known paper machine in respect of web speed. Said patent specification is limited to a double-felted shoe press for the second press nip and, thus, it does not disclose a transfer belt to replace one of the press felts to enable a secure web run and, thereby, higher speeds. Neither does it recognize the possibility of operating with a transfer belt at very high speeds and obtaining good dry-solids content also for mechanical pulp, which is used for manufacturing newsprint, LWC base paper and SC paper. The known paper machine fulrther lacks blowing boxes that generate partial vacuums to secure the firm attachment of the web to the press felt so as to enable high speeds, which result in strong air flows, which can easily detach the web from the press felt.

SUMMARY OF THE INVENTION

The object of the present invention is to provide an improved method and an improved paper or paperboard machine that enables the manufacture of printing paper or paperboard at very high speeds and that furtber enables high efficiency and a great increase in productivity.

The method, in accordance with the invention, is characterized in that

- the web is pressed in a deflection-compensating roll press, having said double-felted roll-press nip and open press rolls,
- the machine is operated at a web speed of at least 1,200 m/min.,
- the web in said roll-press nip is subjected to a linear load ranging from 100 to 300 kN/m, preferably from 120 to 250 kN/m, and a specific pressure ranging from 5 to 15 MPa, preferably from 8 to 11 MPa,
- the web in said shoe-press nip is subjected to a linear load ranging from 500 to 1,500 kN/m, preferably from 700 to 1,200 kN/m, and a specific pressure ranging from 4 to 13 MPa, preferably from 4 to 8 MPa,
- to obtain a dewatered web with a dry-solids content of at least 35 percent, preferably at least 38 percent, after the roll-press nip and at least 45 percent after the shoe-press nip.

The paper or paperboard machine, in accordance with the invention, is characterized in that the roll press has open press rolls with deflection-compensating, rotatably journalled envelope surfaces and in that the machine is arranged to be operated at a web speed of at least 1,200 m/min., with a linear load in the roll-press nip ranging from 100 to 300 kN/m, preferably from 120 to 250 kN/m, and in the shoe-press nip ranging from 500 to 1,500 kN/m, preferably from 700 to 1,200 kN/m, and with a specific pressure in the roll-press nip ranging from 5 to 15 MPa, preferably from 8 to 11 MPa, and in the roll-press nip ranging from 4 to 13 MPa, preferably from 4 to 8 MPa, to obtain a dewatered web with a dry-solids content of at least 35 percent, preferably at least 38 percent, after the roll-press nip and at least 45 percent after the shoe-press nip.

BRIEF DESCRIPTION OF THE DRAWINGS

The invention is further described below with reference to the drawings.

DESCRIPTION OF THE PREFERRED EMBODIMENTS

Figure 1:
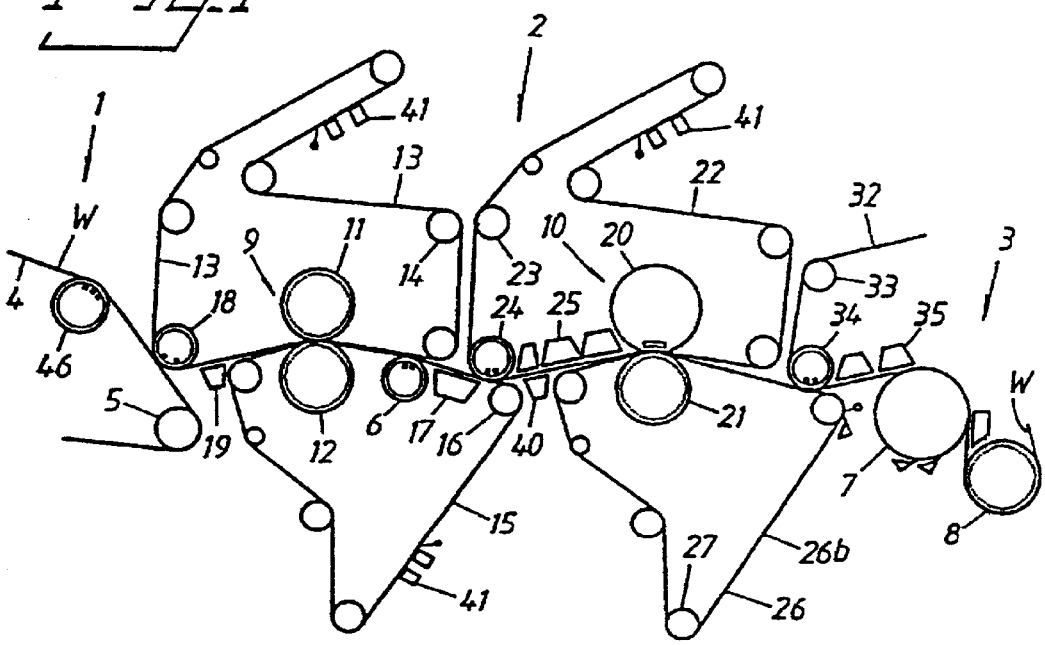
FIG. 1 shows schematically parts of a machine, in accordance with a first embodiment of the invention, for manufacturing a web of cellulosic fiber material.

FIGS. 1–4 show schematically parts of paper or paperboard machines for manufacturing printing paper or paperboard in a continuous web W. Each of the machines comprises a wet section 1, a press section 2 and a drying section 3.

The wet section 1, of which the downstrea npart alone is shown, comprises a forming wire 4, running in a loop around guide rolls 5. In the embodiment according to FIG. 1, a suction roll 46 is arranged in the loop of the forming wire 4 immediately upstream of a pick-up point. Such a suction roll is not always used in wire parts of more recent design, as illustrated in FIGS. 2–4.

The drying section 3 comprises a plurality of drying cylinders 7 and rolls 8, which can be grooved rolls or blind-drilled rolls, as shown, or, alternatively, smooth rolls or conventional suction rolls with or without an inner suction box with sealing devices (in the latter case with interior vacuum) or so-called "Vac" rolls, which have grooves, holes in the grooves and a partial vacuum inside the roll.

Figure 2:
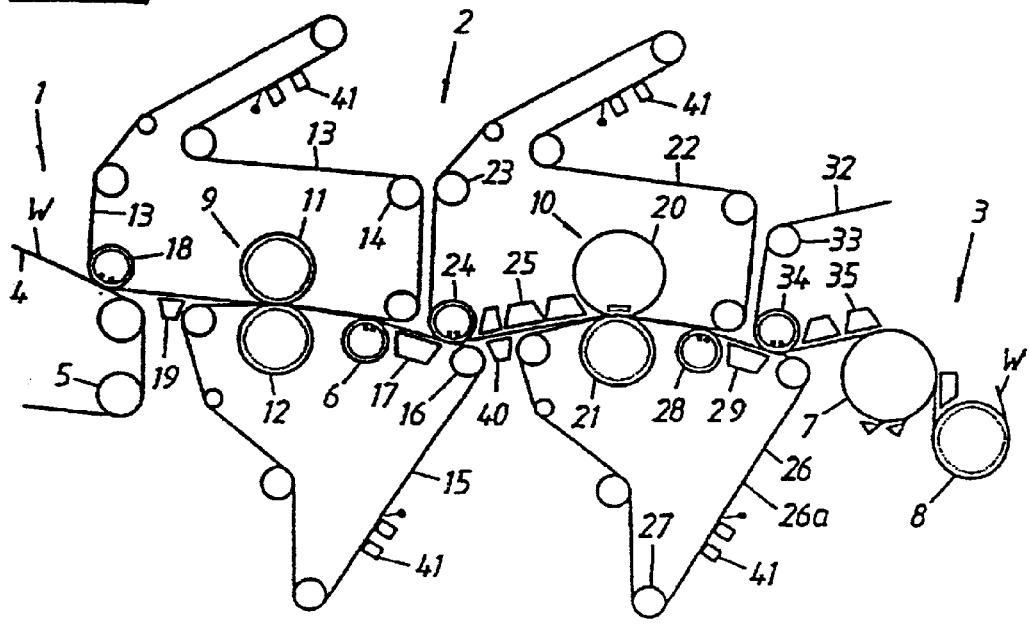
FIG. 2 shows schematically parts of a machine, in accordance with a second embodiment of the invention.
Figure 3:
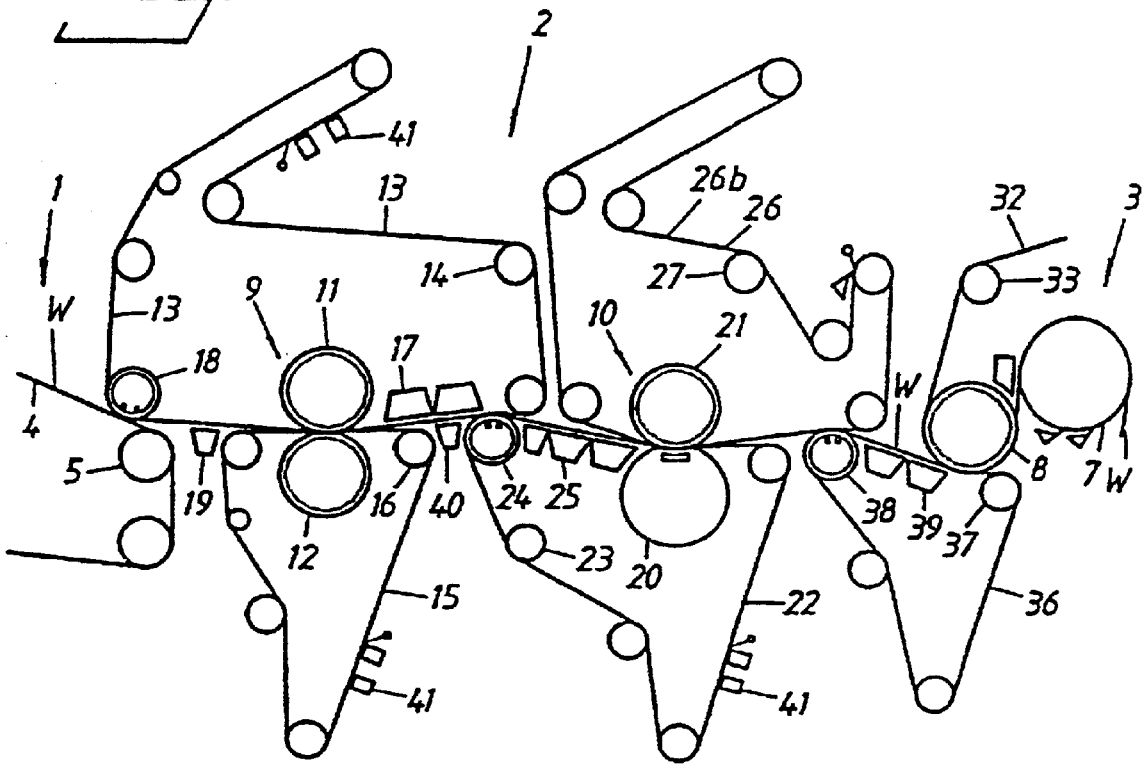
FIG. 3 shows schematically parts of a machine, in accordance with a third embodiment of the invention.
Figure 4:
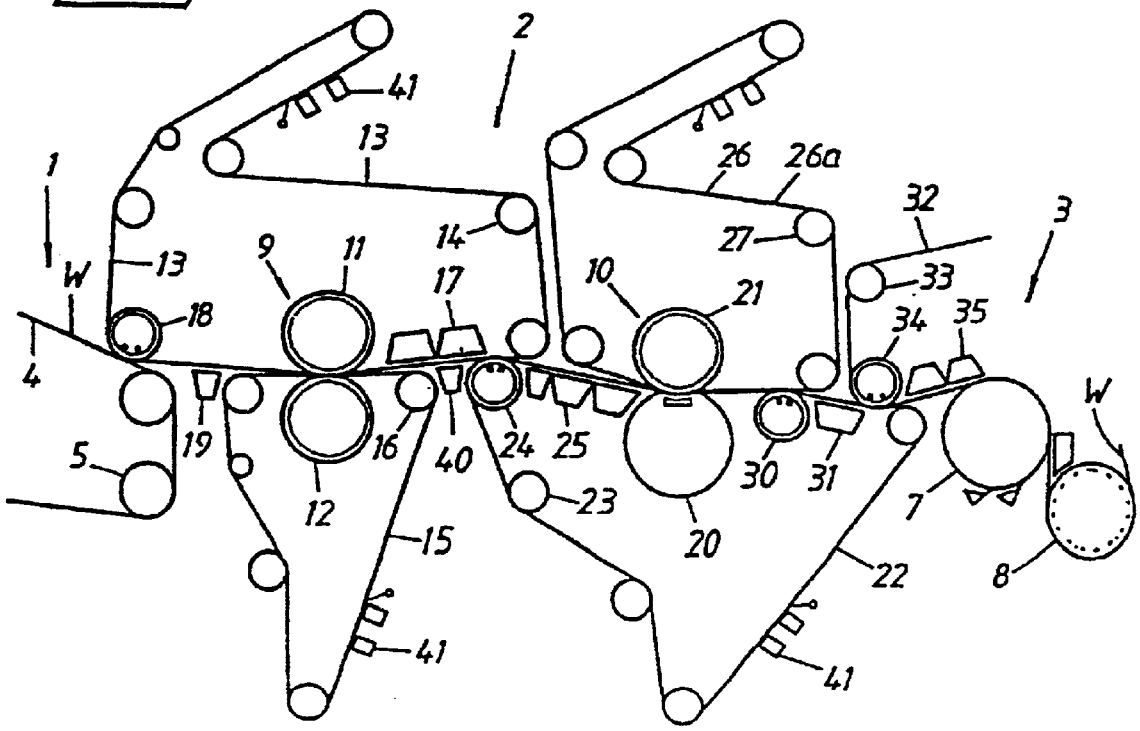
FIG. 4 shows schematically parts of a machine, in accordance with a fourth embodiment of the invention.

The press section 2 comprises a double-felted roll press 9 and, downstream of the roll press 9, a shoe press 10, which can be a single-felted shoe press in accordance with FIGS. 1 and 3 or a double-felted shoe press in accordance with FIGS. 2 and 4. The roll press 9 comprises an open upper press roll 11 and an open lower press roll 12, which press rolls 11,12 co-operate with each other to create a roll-press nip between them.

Further, the roll press 9 comprises an upper endless press felt 13, upper felt, running in a loop through the roll-press nip around a plurality of guide rolls 14, and a lower endless press felt 15, lower felt, running in a loop through the roll-press nip around a plurality of guide rolls 16.

The upper felt 13 of the roll press acts as a pick-up felt and has, in its loop, a pick-up suction roll 18, arranged in close proximity to the forming wire 4 to transfer the web W from the forming wire 4 to the upper felt 13.

In the embodiments in accordance with FIGS. 1 and 2, the lower felt 15 acts as the transfer felt, carrying the web W from the roll-press nip to the shoe press 10, whilst in the embodiments in accordance with FIGS. 3 and 4, the upper felt 13 acts as the transfer felt. In the loop of the press felt 13 or 15, respectively, acting as the transfer felt, blowing boxes generating partial vacuum or suction boxes 17 are arranged downstream of the press nip within the zone where the press felt 13 or 15, respectively, carries the web W. In the embodiments in accordance with FIGS. 1 and 2, a suction roll 6 is additionally arranged in the loop of the lower felt 15 at a point downstream of the roll-press nip where the press felts 13,15 diverge from each other, the suction roll 6 ensuring that the web W accompanies the lower felt 15.

A steam box 19 is arranged in proximity to the outside of the upper felt 13 downstream of the pick-up suction roll 18 for favourable conditioning of the web W with steam before its pressing in the first press nip.

The shoe press 10 comprises a shoe-press roll 20 and a counter roll 21, which rolls 20, 21 co-operate with each other to create an extended shoe-press nip. The shoe press IO further comprises a first, endless press clothing 22 in the shape of a press felt, running in a loop through the extended shoe-press nip around the shoe-press roll 20, around a plurality of guide rolls 23 and around a pick-up suction roll 24, which is arranged in close proximity to the web-carrying lower felt 15 or upper felt 13, respectively, of the roll press 9 to remove and transfer the web W from the web-carrying lower felt 15 or upper felt 13, respectively, of the roll press 9 to the press felt 22 of the shoe press 10, allowing the press felt 22 of the shoe press 10 to act as a pick-up felt as well. Blowing boxes generating partial vacuum or suction boxes 25 are arranged in the loop of the press felt 22 of the shoe press 10, downstream of the pick-up suction roll 24, to retain the web W on the outside of the press felt 22 of the shoe press 10 before the extended shoe press nip. In the embodiment in accordance with FIG. 4, the loop of the press felt 22 accommodates a suction roll 30 downstream of the extended press nip and a subsequent blowing box that generates a partial vacuum or suction box 31.

The shoe press 10 further comprises a second, endless press clothing 26, running in a loop through the extended shoe-press nip around the counter roll 21 and around a plurality of guide rolls 27. In the embodiments in accordance with FIGS. 2 and 4, the second press clothing 26 is a press felt 26*a*, whilst in the embodiments in accordance with FIGS. 1 and 3, it is an impermeable or substantially impermeable transfer belt 26*b* having a smooth web-contacting surface. The first press clothing, i.e. the press felt 22, in the loop of which the shoe-press roll 20 is located, is arranged in a top position (as is the shoe-press roll 20) in the embodiments in accordance with FIGS. 1 and 2, whilst it is arranged in a bottom position (as is the shoe-press roll 20) in the embodiments in accordance with FIGS. 3 and 4. In the embodiment in accordance with FIG. 2, a suction roll 28 and a subsequent blowing box generating partial vacuum or suction box 29 are situated downstream of the extended press nip in the loop of the press felt 26*a*, which accommodates the counter roll 21.

In the embodiments shown, the counter roll 21 of the shoe press 10 is shown as a grooved roll or a blind-drilled roll. Alternatively, the counter roll is a smooth roll.

In the embodiments in accordance with FIGS. 1 and 2, the web W is transferred from the lower felt 15 of the roll press 9 to the upper felt 22 of the shoe press 10, whilst in the embodiments in accordance with FIGS. 3 and 4, the web W is transferred from the upper felt 13 of the roll press 9 to the lower felt 22 of the shoe press 10. The lower clothing 26 of the shoe press 10, in the embodiments in accordance with FIGS. 1 and 2, and the lower clothing 22 of the shoe press 10, in the embodiment in accordance with FIG. 4, are arranged to carry the web W after the extended shoe-press nip up to the drying section 3; whilst, in the embodiment in accordance with FIG. 3, the upper clothing 26 of the shoe press 10 in the form of the transfer belt 26*b* is arranged to carry the web W after the extended shoe-press nip.

The drying section 3 comprises an endless, permeable drying clothing 32 in the form of a mesh dryer or dryer felt, running in a loop around a plurality of guide rolls 33, the drying cylinders 7 and the rolls 8. In the embodiments in accordance with FIGS. 1, 2 and 4, the mesh dryer or the dryer felt 32 also runs around a pick-up suction roll 34, arranged in close proximity to the lower clothing 22 alternatively 26*a* or 26*b* of the shoe press 10 so that the pressed web W is transferred from the lower clothing 22 alternatively 26*a* or 26*b* to the mesh dryer or dryer felt 32. Blowing boxes generating partial vacuum or suction boxes 35 are arranged in suitable locations in the loop of the mesh dryer or dryer felt 32. The embodiment in accordance with FIG. 3 employs a separate, endless pick-up clothing 36, which can be a wire or a felt and which runs in a loop around a plurality of guide rolls 37 and a pick-up suction roll 38, arranged in close proximity to the second press clothing 26 of the shoe press 10, i.e. the transfer belt 26*b*, to transfer the pressed web W from the transfer belt 26*b* to the pick-up clothing 36. A blowing box generating partial vacuum or suction box 39 is arranged downstream of the pick-up suction roll 38 in the loop of the pick-up wire or pick-up felt 36. In the embodiment in accordance with FIG. 3, the first upstream roll 8 in the drying section is arranged in close proximity to the pick-up wire or pick-up felt 36 so that the pressed web W is transferred from the pick-up wire or pick-up felt 36 to the mesh dryer or dryer felt 32.

A steam box 40 is arranged in a free space, where the underside of the web W is exposed, situated between the lower felt 15 of the roll press 9 and the lower clothing 22 or 26, respectively, of the shoe press 10, in close proximity either to the upper felt 13 of the roll press 9 in accordance with FIG. 3, for instance, or to the upper clothing 26 or 22, respectively, of the shoe press in accordance with FIG. 1.

Designation number 41 denotes suitable equipment for conditioning the press felts 26*a*.

As is evident from the drawings, the press section has a closed web run from the wet section to the drying section and provides good runability for all grades of printing paper as well as enabling very high operating speeds. The press section has two press nips optimized to achieve good runability and dry-solids content. The suction roll and the blowing boxes after the roll nip result in good runability. The second press nip is a shoe-press nip where a very high nip load can be used and a very high dry-solids content can be achieved. By using a steam box before the first press nip and, especially, after the second press nip, a better dry-solids content can be achieved and the profile of the dry-solids content can be controlled.

At all the pick-up points, suction rolls are present to ensure that the web is transferred from one clothing to another, as well as blowing boxes generating partial vacuum or suction boxes to ensure that the web is retained adhered to the clothing. These measures, fuirthermore, contribute to good runability and enabling operation at very high speeds without web ruptures occurring. The partial vacuum in the suction roll 6 is in the range of about 10–30 kPa, in the suction roll 24 about 15–40 kPa and in the suction roll 28 about 10–30 kPa, if this is used. The partial vacuum in the suction roll 34 is in the range of about 15–40 kPa. The blowing boxes 17, 25, 29 generating partial vacuum provide a partial vacuum of about 300–1,000 Pa.

A web transfer of the type shown in FIGS. 3 and 4 for transferring the web from the roll press to the shoe press is particularly suitable for manufacturing paperboard, as there are open, wedge-shaped gaps after the roll-press nip and before the shoe-press nip.

Figure 1A:
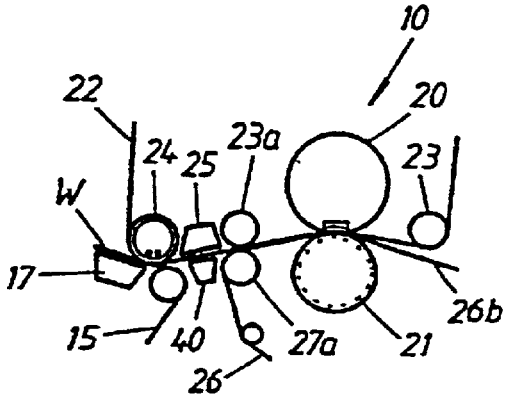
FIG. 1*a* shows parts of a press section, modified in relation to the one in the machine in accordance with FIG. 1.

FIG. 1*a* shows parts of a press section similar to the one in the machine in accordance with FIG. 1, but with a modified configuration of the shoe press 10 in respect of the run of the lower press clothing 26, i.e. the transfer belt 26*b*, relative to the upper felt 22 before the extended shoe-press nip. The guide roll 27*a* located nearest to the shoepress nip is elevated and arranged close to the upper felt 22 so that, in the direction away from the elevated guide roll 27*a*, the transfer belt 26*b* runs in contact with the upper felt 22, enclosing the web W between them to form a sandwich construction. An additional guide roll 23*a* is arranged in the loop of the upper felt 22 at the position of said elevated guide roll 27*a* to create a nip not compressing the web. The shoe press in the machine in accordance with FIG. 2 can be modified in the same way as shown in FIG. 1*a*. The use of such a sandwich construction, which follows after the steam box 40, means that the distance between the web W and the steam box 40 becomes very precise. Furthermore, the number of blowing boxes generating partial vacuum or suction boxes 25 can, in the embodiment shown in FIG. 1*a*, be reduced to a single one.

Figure 3A:
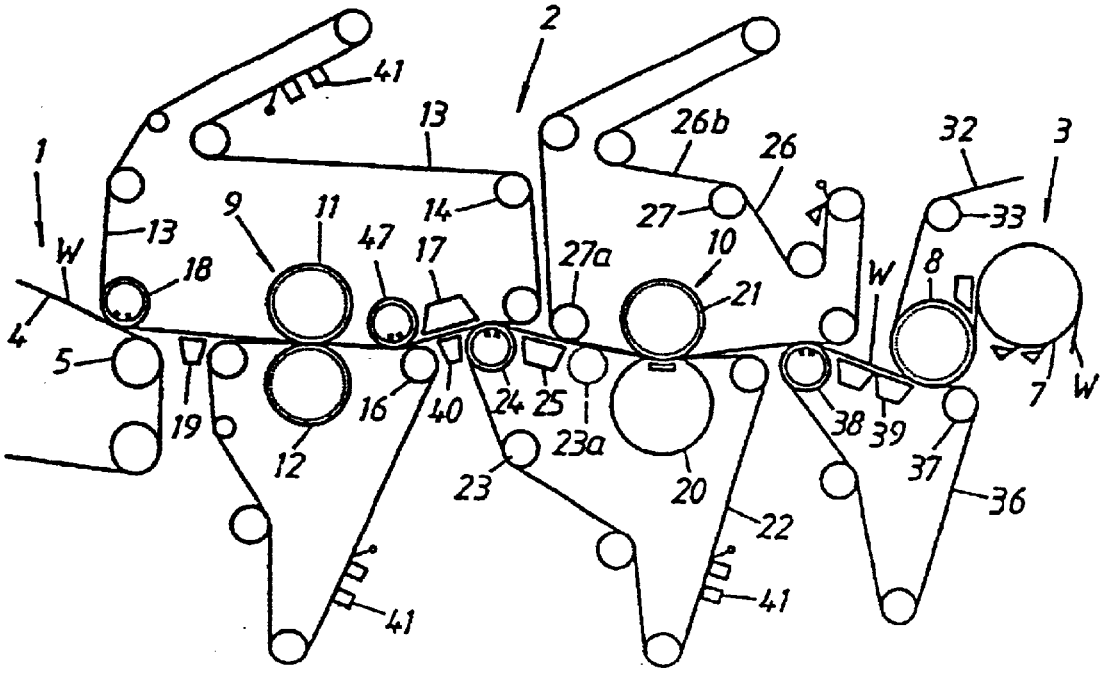
FIG. 3*a* shows parts of a machine, the press section of which is modified in relation to the one in the machine in accordance with FIG. 3.

FIG. 3*a* shows part of a machine similar to the one in accordance with FIG. 3, but with a modified configuration of the roll press 9 and the shoe press 10 in respect of the run of the lower press clothings 15, 22 and the upper press clothings 13, 26 relative to each other after and before the press nip. In the loop of the upper felt 13 of the roll press 9, a suction roll 47 is arranged downstream of the roll-press nip to guide the upper felt 13 into contact with the lower felt 15 so that the upper and lower felts 13, 15 and the web W enclosed therebetween form a sandwich construction after the roll-press nip. In such an embodiment, with a suction roll 47 in the loop of the upper felt 13 carrying the web, it is possible to reduce the number of blowing boxes generating partial vacuum or suction boxes 17 to, for instance, a single one in accordance with the embodiment shown. In the loop of the transfer belt 26*b* of the shoe press 10, the upstream guide roll 27*a* located nearest to the shoe-press nip is lowered and arranged close to the lower felt 22 so that, in the direction away from the lowered guide roll 27*a*, the transfer belt 26*b* runs in contact with the lower felt 22, enclosing the web W between them to form a sandwich construction. An additional guide roll 23*a* can be arranged in the loop of the lower felt 22 to support the sandwich construction, if so desired. Accordingly, in such an embodiment of the shoe press 10, where the web W is enclosed in a sandwich construction, no blowing boxes generating partial vacuum or suction boxes are required in this run. One or several such boxes 25 are arranged along the whole or part of the zone where the web runs with its top side exposed, i.e. in a closed draw before said sandwich construction in the shoe press, the number of boxes 25 being adapted to the length of the closed draw. The machine in accordance with FIG. 4 can be modified in the same way as the one in accordance with FIG. 3 to obtain a sandwich construction after the roll-press nip as well as before the shoe-press nip in conformity with FIG. 3*a*.

A web run of the type shown in FIG. 3*a* for conveying the web from the roll-press nip to the shoe-press nip is particularly suitable for manufacturing printing paper at high speeds, as the open, wedge-shaped gaps after the roll-press nip and before the shoe-press nip have been eliminated.

Figure 5:
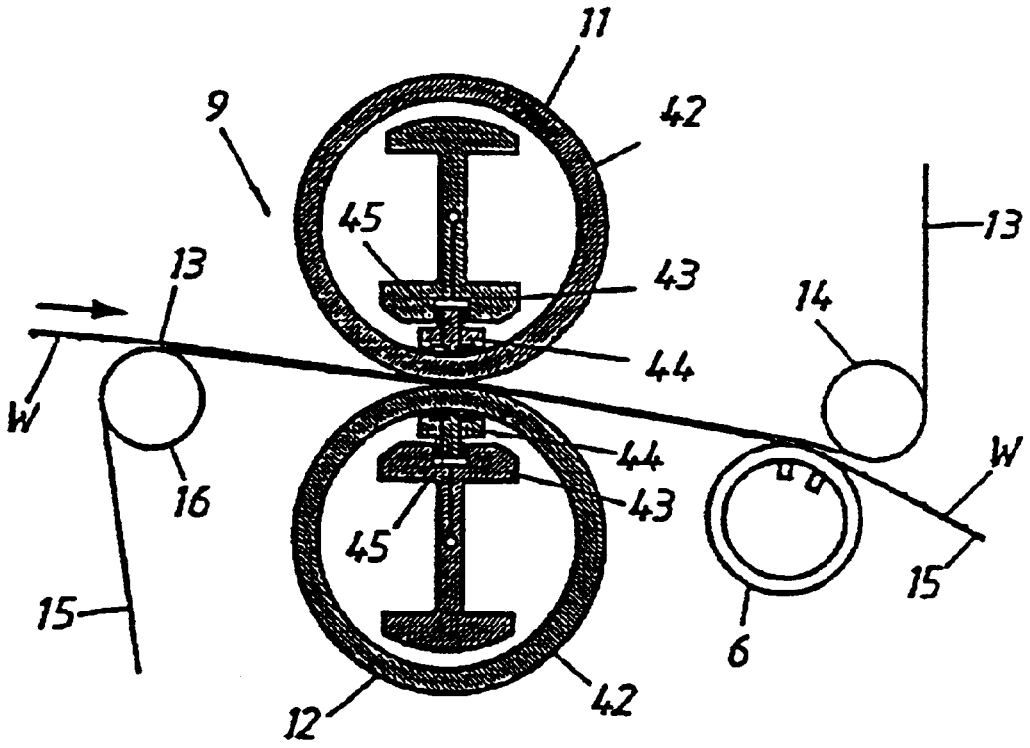
FIG. 5 shows in detail the special roll press that forms part of the embodiments shown in accordance with FIGS. 1–4.

In the embodiments shown of the machine in accordance with the invention, the press rolls of the roll press are of the deflection-compensating type, as illustrated in detail in FIG. 5. Each press roll has a rotatable envelope surface 42 and an inner, static I-shaped beam 43, extending axially between the end walls and supporting an elongate shoe member 44 that comprises a plurality of hydrostatic and hydrodynamic slide shoes, arranged in a row and hydraulically loaded between the I beam 43 and the envelope surface 42 by way of power cylinders 45, a thin film of oil being maintained between each slide shoe and the inside of the envelope. Thanks to such a construction, the vibrations in the press rolls are damped in a very effective manner. Thus, the two shoe members 44 act against the insides of the envelope surfaces within the roll-press nip and can be controlled section by section in relation to each other to compensate for deflections in the envelope surfaces of the press rolls. The press rolls are blind-drilled or grooved. Preferably, the envelope surface of each press roll has an outer layer of steel, exhibiting grooves with a width of about 0.5 mm, for instance, and a depth of about 5 mm, for instance, the cc distance between two adjacent parallel grooves being about 2.25 mm, for instance. Thus, the grooved press roll has a very large aggregate groove volume, namely 1.1 $dm^3/m^2$ of envelope surface with the specified groove values. Such a high groove volume has been found to be favourable for avoiding streams of water and crushing. The narrowness of the grooves (0.5 mm) avoids groove markings in the web.

As the grooved layer is made of steel, the groove volume remains constant during pressing even at very high linear loads in the roll-press nip. The described properties of the press rolls therefore contribute to high web speeds being feasible and high levels of dry-solids content being obtained already after the first press nip without the web being crushed. Generally, the aggregate groove or void volume is in. the range of 0.7–1.8 $dm^3/m^2$ of envelope surface.

Thus, the described deflection-compensating press rolls effectively eliminate the vibrations created at high linear loads, high specific top pressures and high web speeds.

The linear load in the roll-press nip is in the range of 100–300 kN/m, preferably 120–250 kN/m, and in the shoe-press nip 500–1,500 kN/m, preferably 700–1,200 kN/m.

The specific pressure in the roll-press nip is in the range of 5–15 MPa, preferably 8–11 MPa, and in the shoe-press nip 4–13 MPa, preferably 4–8 MPa.

The dry-solids content of the web after the wet section is generally in the range of 15–22 percent, depending on the type of printing paper, the dry-solids content for fine paper normally being 18–22 percent, for newsprint and LWC base paper, 16–18 percent, and for SC paper, 15–17 percent.

Generally, the web speed is currently generally in the range of 1,200–1,700 m/min. depending on the type of printing paper, amongst other factors, the speed for fine paper in modem paper machines and press sections typically being about 1,200–1,500 m/min., for newsprint about 1,300–1,700 m/min., for LWC base paper about 1,400–1,600 m/min. and for SC paper about 1,400–1,600 m/min.

To obtain good runability at very high speeds, i.e. over 1,700 m/min., the shoe press 10 is preferably provided with a transfer belt, which is more favourable in the bottom position, i.e. in accordance with FIG. 1.

The higher the dry-solids content obtained after the roll press is, the better the runability between the roll press and the shoe press becomes.

When the shoe press employs a transfer belt and a press felt, the water will be pressed out of the web in only one direction, i.e. towards the press felt, which means that the web becomes asymmetrical, having dissimilar sides (smooth and uneven, respectively). Consequently, it holds good that the more water that can be removed from the web in the double-felted roll-press nip, the less water needs to be removed in the shoe-press nip, which results in an improved symmetry of density in the z direction.

In the following, an account is given of the designs and results of a number of experiments in manufacturing different grades of printing paper, the properties of which are as follows.

Fine paper: Chemical pulp, filler content about 12–18 percent, filler usually calcium carbonate, granmmage 40–200 $g/m^2$.

Newsprint: Mechanical pulp, no filler, grammage about 40–48 g/m.

SC paper: Mechanical pulp 70–80 percent and chemical pulp 30–20 percent, kaolin filler about 30 percent, grammage about 42–56 $g/m^2$.

LWC base paper: Mechanical pulp 55–60 percent, chemical pulp 45–40 percent, filler about 5–15 percent, grammage 33–45 $gim^2$.

| Experiment 1 | |
|---|---|
| Press section: | In accordance with FIG. 1 |
| Type of printing paper: | LWC base paper |
| Grammage: | 40 $g/m^2$ |
| Web speed: | 1,500 m/min. |
| Design of 1st press: | Grooved rolls |
| Design of 2nd press: | Shoe length 200 mm, shoe-press roll with grooved envelope surface, transfer belt as bottom clothing |
| Linear load in 1st press: | 200 kN/m |
| Linear load in 2nd press: | 1,100 kN/m |
| Specific pressure in 1st press: | 9.0 MPa |
| Specific pressure in 2nd press: | 7.3 MPa |
| Results: | |
| Dry-solids content after 1st press: | 39 per cent |
| Dry-solids content after 2nd press: | 49 per cent |

| Experiment 2 | |
|---|---|
| Press section: | In accordance with FIG. 1 |
| Type of printing paper: | SC paper |
| Grammage: | 56 $g/m^2$ |
| Web speed: | 1,500 m/min. |
| Design of 1st press: | Grooved rolls |
| Design of 2nd press: | Shoe length 200 min, shoe-press roll with grooved envelope surface, transfer belt as bottom clothing |
| Linear load in 1st press: | 200 kN/m |
| Linear load in 2nd press: | 1,100 kN/m |
| Specific pressure in 1st press: | 9.0 MPa |
| Specific pressure in 2nd press: | 7.3 MPa |
| Results: | |
| Dry-solids content after 1st press: | 42 per cent |
| Dry-solids content after 2nd press: | 57 per cent |

| Experiment 3 | |
|---|---|
| Press section: | In accordance with FIG. 1 |
| Type of printing paper: | Fine paper |
| Grammage: | 80 $g/m^2$ |
| Web speed: | 1,500 m/min. |
| Design of 1st press: | Grooved rolls |
| Design of 2nd press: | Shoe length 200 mm, shoe-press roll with grooved envelope surface, transfer belt as bottom clothing |
| Linear load in 1st press: | 200 kN/m |
| Linear load in 2nd press: | 1,100 kN/m |
| Specific pressure in 1st press: | 9.0 MPa |
| Specific pressure in 2nd press: | 7.3 MPa |
| Results: | |
| Dry-solids content after 1st press: | 38 per cent |
| Dry-solids content after 2nd press: | 48 per cent |

| Experiment 4 | |
|---|---|
| Press section: | In accordance with FIG. 2, but web run to the first nip in accordance with FIG. 1 |
| Type of printing paper: | Fine paper |
| Grammage: | 101 $g/m^2$ |
| Web speed: | 1,200 m/min. |
| Design of 1st press: | Grooved rolls |
| Design of 2nd press: | Shoe length 250 mm, shoe-press roll with grooved envelope surface, felt as bottom clothing |
| Linear load in 1st press: | 200 kN/m |
| Linear load in 2nd press: | 1,000 kN/m |
| Specific pressure in 1st press: | 9.0 MPa |
| Specific pressure in 2nd press: | 6.2 MPa |
| Results: | |
| Dry-solids content after 1st press: | 38.9 per cent |
| Dry-solids content after 2nd press: | 46.1 per cent |

-continued

Experiment 5

| | |
|---|---|
| Press section: | In accordance with FIG. 1 |
| Type of printing paper: | SC paper |
| Grammage: | 52 g/m$^2$ |
| Web speed: | 1,400 m/min. |
| Design of 1st press: | Grooved rolls |
| Design of 2nd press: | Shoe length 220 mm, shoe-press roll with grooved envelope surface, transfer belt as bottom clothing |
| Linear load in 1st press: | 250 kN/m |
| Linear load in 2nd press: | 1,200 kN/m |
| Specific pressure in 1st press: | 10.0 MPa |
| Specific pressure in 2nd press: | 7.5 MPa |
| Results: | |
| Dry-solids content after 1st press: | 42.9 per cent |
| Dry-solids content after 2nd press: | 49.6 per cent |

Experiment 6

| | |
|---|---|
| Press section: | In accordance with FIG. 1 |
| Type of printing paper: | SC paper |
| Grammage: | 52.3 g/m$^2$ |
| Web speed: | 1,200 m/min. |
| Design of 1st press: | Grooved rolls |
| Design of 2nd press: | Shoe length 220 mm, shoe-press roll with grooved envelope surface, transfer belt as bottom clothing |
| Linear load in 1st press: | 250 kN/m |
| Linear load in 2nd press: | 1,200 kN/m |
| Specific pressure in 1st press: | 10.0 MPa |
| Specific pressure in 2nd press: | 7.5 MPa |
| Results: | |
| Dry-solids content after 1st press: | 46.1 per cent |
| Dry-solids content after 2nd press: | 51.4 per cent |

Experiment 7

| | |
|---|---|
| Press section: | In accordance with FIG. 2, but web run to the first nip in accordance with FIG. 1 |
| Type of printing paper: | Fine paper |
| Grammage: | 80 g/m$^2$ |
| Web speed: | 1,200 m/min. |
| Design of 1st press: | Grooved rolls |
| Design of 2nd press: | Shoe length 250 mm, shoe-press roll with grooved envelope surface, felt as bottom clothing |
| Linear load in 1st press: | 250 kN/m |
| Linear load in 2nd press: | 700 kN/m |
| Specific pressure in 1st press: | 10.0 MPa |
| Specific pressure in 2nd press: | 4.2 MPa |
| Results: | |
| Dry-solids content after 1st press: | 42 per cent |
| Dry-solids content after 2nd press: | 45 per cent |

Experiment 8

| | |
|---|---|
| Press section: | In accordance with FIG. 1 |
| Type of printing paper: | Newsprint |
| Grammage: | 48 g/m$^2$ |
| Web speed: | 1,500 m/min. |
| Design of 1st press: | Grooved rolls |
| Design of 2nd press: | Shoe length 220 mm, shoe-press roll with grooved envelope surface, transfer belt as bottom clothing |
| Linear load in 1st press: | 250 kN/m |
| Linear load in 2nd press: | 1,000 kN/m |
| Specific pressure in 1st press: | 10.0 MPa |
| Specific pressure in 2nd press: | 6.2 MPa |
| Results: | |
| Dry-solids content after 1st press: | 38 per cent |
| Dry-solids content after 2nd press: | 48 per cent |

Experiment 9

| | |
|---|---|
| Press section: | In accordance with FIG. 1 |
| Type of printing paper: | SC paper |
| Grammage: | 52 g/m$^2$ |

-continued

| | |
|---|---|
| Web speed: | 1,600 m/min. |
| Design of 1st press: | Grooved rolls |
| Design of 2nd press: | Shoe length 220 mm, shoe-press roll with grooved envelope surface, transfer belt as bottom clothing |
| Linear load in 1st press: | 200 kN/m |
| Linear load in 2nd press: | 700 kN/m |
| Specific pressure in 1st press: | 9.0 MPa |
| Specific pressure in 2nd press: | 4.2 Mpa |
| Results: | |
| Dry-solids content after 1st press: | 41 per cent |
| Dry-solids content after 2nd press: | 55 per cent |

The experiments reported on above show that good levels of dry-solids content can be obtained at high web speeds. The results are surprising, as it has previously been believed that a short roll nip, 40–60 mm, resulting in a short dwell time, 1.2–2.5 ms, fails to provide a good dry-solids content at high machine speeds. In all the experiments, with different grades of paper and grammage, the web was pressed in the first roll-press nip without being crushed. This is very surprising.

A press section with a first press in the shape of a double-felted roll press and a second press in the shape of a shoe press constitute a cheaper configuration than a press section with two shoe presses.

The first roll press provides very good levels of dry-solids content with linear loads in the roll-press nip of 120–250 kN/m, which in some cases is much better than is provided by a shoe press with a linear load of 1,000 kN/m. The reason for this is that the roll press at high linear loads creates much higher specific top pressures than a shoe press with an extended nip with a high load. This results in good water removal and dry-solids content, especially in the double-felted roll-press nip.

The described deflectioncompensating, open press rolls in top and bottom positions very effectively prevent vibrations that constitute a problem with ordinary, solid press rolls when the linear load and the web speed are high. The two deflection-compensating, open press rolls described have their shoe members acting against each other and the stresses on the envelope surfaces of the press rolls will therefore be low at high linear loads in the roll-press nip. The deflection-compensating, open press rolls do not require cambering and therefore the CD profile in the roll-press nip can be controlled so that it becomes very straight. Futhermore, the profile of the press felts will be good and the service life of the feltswill increase.

What is claimed is:

1. A method for manufacturing printing paper or paperboard with a grammage of 30–200 g/m$^2$ in a paper or paperboard machine, cormprising a wet section, a press section and a drying Section, in which mcthod a web, formed in thc wet section, is pressed in a roll press with a double-felted roll-press nip and, thereafter, in a shoe press with an extended single or double-felted shoe-press nip, wherein:

the web is pressed in a deflection-compensating roll press, having said doublefelted roll-press nip and open press rolls;

the machine is operated at a web speed of at least 1,200 m/min.;

the web in said roll-press nip is subjected to a linear load ranging from 100 to 300 kN/m, and a specific pressure ranging from 5 to 15 MPa; and the web in said shoe-press nip is subjected to a linear load ranging from 500 to 1,500 kN/n, and a spedfic presurc ranging from 4 to 13 MPa; and to obtain a dewatered web with a dry-solids content of at least 35 percent, preferably at least 38 percent, after the roll-press nip and at least 45 percent after the shoe-press nip.

2. The method of claim 1 wherein said roll-press nip is subjected to a linear load ranging from 120 to 250 kN/m.

3. The method of claim 1 wherein said roll-press nip is subjected to a specific pressure ranging from 8 to 11 MPa.

4. The method of claim 1 wherin the web in said shoe-press nip is subjected to a linear load ranging from 700 to 1,200 kN/m.

5. The method of claim 1 wherein the web in said shoe-press nip is subjected to a specific pressure ranging from 4 to 8 MPa.

6. The method of claim 1 wherein the web, after the roll-press nip, is brought to adhere to a press felt acting as a tasfer felt in the roll press with the aid of a suction roll and/or one or several blowing boxes that generate partial vacuum or suction boxes.

7. The method of claim 6, wherein the web is conveyed to the shoe-press nip enclosed br n first and second press clothi in a sandwich construction.

8. The method of claim 1 wherein the web, after the shoe-press nip, which is double-felted, is brought to adhere to a press felt acting as a transfer felt in the shoe press with the aid of a suction roll and/or one or several blowing boxes that generate partial vacuum or suction boxes.

9. The method of claim 1 wherein the web, after the shoe-press nip, which is single-felted, is brought to adhere to a press clothing acting as a transfer belt having a smooth web-contacting surface.

10. The method of claim 1, wherein the web, having been transferred from the roll press to the shoe press, is brought to adhere to a prss felt acting as the felt carrying the web in the shoe press with the assistance of blowing boxes that generate partial vacuum or suction boxes, atrnged in the loop of said press felt.

11. The method of claim 1, wherein the web is transferred from the roll press to the shoe press with the aid of a pick-up suction roll, arranged in the loop of a press felt of the shoe press, which press felt carries the web to the shoe-prss nip.

12. The method of claim 1, wherein the web is conveyed from the roll-press nip enclosed between upper and lower press felts in a sandwich construction.

13. The method of claim 1, wherein the web is conveyed from the roll-press nip to the shoe-press nip enclosed between upper and lower press felts in a first sandwich construction and, following a closed draw between the roll press and the shoe press, thereafter enclosed bctwecn first and second press clothings of the shoe press in a second sandwich construction.

14. The method of claim 1 wherein the web is prsed in the deflection-compersating roll press, the rolls of which each have a water-receiving capacity of 0.7–1.8 $dm^3/m^2$ of envelope surface.

15. A paper or paperboard machine for mnanufacturing printing paper or paperboard at high speed, which printing paper or paperboard has a grammage of 30–200 $g/m^2$, comprising a wet section, a press section and a drying section, which press section includes a roll press, having a double-felted roll-press nip, and a shoe press, having an extended single or double-felted shoe-press nip, wherein the roll press has open press rolls with deflection-compensating, rotatablyjournalled envelope surfaces and wherein the machine is arranged to be operated at a web speed of at least 1,200 m/min, with a linear load in the roll-press nip ranging from 100 to 300 kN/m, and in the shoe-press nip ranging from 500 to 1,500 kN/m, and with a specific pressure in the roll-prss nip raneing from 5 to 15 MPa, and in the shoe-press nip ranging from 4 to 13 MPa, to obtain a dewatered web with a dry-solids content of at least 35 percent, preferably at least 38 percent, after the roll-press nip and at least 45 percent after the shoe-press nip, wherein the open press rolls each have an envelope surface of steel with a plurality of grooves for receiving water, that together have a volume per square metre of envelope surface of 0.7–1.8 $dm^3$, the grooves having a width of about 0.5 mm.

16. The machine of claim 15 wherein the linear load in the roll-pres nip ranges from 120 to 250 kN/m.

17. The machine of claim 15 wherein the linear load in the shoe-press nip ranges from 700 to 1,200 kN/m.

18. The machine of claim 15 wherein the specific pressure in the roll-press nip ranges from 8 to 11 MPa.

19. The machine of claim 15 wherein the specific pressure in the shoe-press nip ranges from 4 to 8 MPa.

20. The macbine of claim 15, wherein a suction roll and/or one or several blowing boxes that generate partial vacuum or suction boxes am arranged after the roll-press nip in the loop of a press felt acting as a transfer felt in the roll press.

21. The machine of claim 20, wherein first and second press clothings of the shoe press are arranged to run in contact with each other before the shoe-press nip, whilst enclosing the web between them, to fonn a sandwich construction up until the shoe-press nip.

22. The machine of claim 15, wherein a suction roll and/or one or several blowing boxes that generate partial vacuum or suction boxes are arranged after the shoe-press nip, which is double-feltod, in the loop of a press felt acting as a transfer felt in the shoe press.

23. The machine of claim 15, wherein the shoe press has a press clothing which is an impermeable transfer belts having a smooth surface, to which the web adheres after the shoe-press nip.

24. The machine of claim 23, wherein the impermeable transfer belt is arranged as a lower press clothing in the shoe press.

25. The machine of claim 15 further comiprising a plurality of blowing boxes that generate partial vacuum, said pluarality of blowing boxes being arranged in the loop of a press felt arranged to carry the web in the shoe press from the roll press to the shoe-press nip.

26. The machine of claim 15 wherein a pick-up suction roll is arranged in the shoe press in a loop of a press felt arranged to carry the web to the shoe-press nip, which pick-up suction roll is arranged with said press felt to cooperate with the press felt acting as a transfer felt in the roll press to transfer the web to said press felt.

27. The machine of claim 15, wherein upper and lower press felts of the roll press are arranged to run in contact with each other from the roll-press nip, whilst enclosing the web between therm, to form a sandwich construction up until a suction roll arranged in the loop of the web carrying press felt.

28. The machine of claim 15, wherein upper and lower press flts of the roll press are arranged to run in contact with each other, whilst enclosing the web between them, to form a first sandwich construction up until a suction roll arranged in the loop of the press felt carrying the web, and in that first and second press clothings of the shoe press are arranged to run in contact with each other before the shoe-press nip, whilst enclosing the web between them, to form a second sandwich construction up until the shoe-press nip.

29. The machine of claim 15 wherein the groove or volume is about 1.1 $dm^3/m^2$ of envelope surface.

30. The machine of claim 29, wherein the press roll is gooves have a depth of about 5 mm, the cc distance between two adjacent grooves being about 2.25 mm.

* * * * *

UNITED STATES PATENT AND TRADEMARK OFFICE

CERTIFICATE OF CORRECTION

PATENT NO. : 6,730,192 B1
DATED : May 4, 2004
INVENTOR(S) : Jorma Laapotti

It is certified that error appears in the above-identified patent and that said Letters Patent is hereby corrected as shown below:

Column 1,
Line 24, “doublefelted” should be -- double-felted --
Line 38, “suarfces” should be -- surfaces --

Column 3,
Line 1, “downstrea npart” should be -- downstream part --
Line 54, “IO” should be -- 10 --

Column 5,
Line 53, “shoepress” should be -- shoe-press --

Column 7,
Line 16, “in.” should be -- in --

Column 8,
Line 3, “gim$^2$” should be -- g/m$^2$ --

Column 10,
Line 36, “deflectioncompensating” should be -- deflection-compensating --
Line 46, “the profile” should be -- the moisture profile --
Line 47, “feltswill” should be -- felts will --
Line 58, “doublefelted” should be -- double-felted --
Line 66, “spedfic presurc” should be -- specific pressure --

Column 11,
Line 17, “tasfer” should be -- transfer --
Line 20, “br n” should be -- between --
Line 21, “clothi” should be -- clothings --
Line 33, “prss” should be -- press --
Line 39, “shoe-prss” should be -- shoe-press --
Line 47, “bctwecn” should be -- between --
Line 50, “prsed” should be -- pressed --
Line 61, “rotatablyjournalled” should be -- rotatably-journalled --

UNITED STATES PATENT AND TRADEMARK OFFICE

CERTIFICATE OF CORRECTION

PATENT NO. : 6,730,192 B1
DATED : May 4, 2004
INVENTOR(S) : Jorma Laapotti

It is certified that error appears in the above-identified patent and that said Letters Patent is hereby corrected as shown below:

Column 12,
Line 23, “fonn” should be -- form --
Line 28, “double-feltod” should be -- double-felted --
Line 31, “belts” should be -- belt, --
Line 45, “cooperate” should be -- co-operate --
Line 61, “groove or volume” should be -- groove volume --
Line 63, “roll is grooves” should be -- roll grooves --

Signed and Sealed this

Thirtieth Day of November, 2004

JON W. DUDAS
*Director of the United States Patent and Trademark Office*